US006827025B2

(12) United States Patent
Gaydos et al.

(10) Patent No.: US 6,827,025 B2
(45) Date of Patent: Dec. 7, 2004

(54) HATCH COVER FOR A RAILROAD HOPPER CAR

(75) Inventors: Christopher C. Gaydos, Maple Park, IL (US); Michael R. Palermo, Bartlett, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 10/397,086

(22) Filed: Mar. 26, 2003

(65) Prior Publication Data

US 2004/0187728 A1 Sep. 30, 2004

(51) Int. Cl.[7] ..... B61D 39/00

(52) U.S. Cl. ..... 105/377.07; 220/62.19; 55/307; 105/377.08

(58) Field of Search ..... 105/377.07, 377.08; 220/62.19, 62.21, 62.22, 371, 367.1; 55/307, 308, 385.1, 385.4, 385.3

(56) References Cited

U.S. PATENT DOCUMENTS 2,607,302 A * 8/1952 Nystrom ..... 105/377.07
2,652,787 A * 9/1953 Keleher ..... 105/377.07
3,126,591 A * 3/1964 Hamilton ..... 49/489.1
3,250,233 A 5/1966 Carney et al.
3,259,078 A 7/1966 Radey et al.
3,266,440 A 8/1966 Price et al.
3,307,498 A 3/1967 Stevens
4,239,008 A * 12/1980 Conlon ..... 105/377.08
4,368,674 A * 1/1983 Wiens et al. ..... 105/377.01
4,635,979 A 1/1987 Blume
4,638,743 A 1/1987 Loomis
4,840,126 A 6/1989 Kleykamp
4,978,582 A * 12/1990 Stamm et al. ..... 428/551
4,998,642 A 3/1991 Kraus
5,517,925 A 5/1996 Early
6,085,664 A * 7/2000 Early ..... 105/377.07
6,199,939 B1 3/2001 Ehrlich
6,205,943 B1 * 3/2001 Lonno et al. ..... 114/117
6,220,651 B1 4/2001 Ehrlich
6,412,854 B2 7/2002 Ehrlich
6,494,338 B1 * 12/2002 Schultz ..... 220/328

* cited by examiner

*Primary Examiner*—Frantz F. Jules
(74) *Attorney, Agent, or Firm*—John W. Harbst

(57) ABSTRACT

A hatch cover adapted to be positioned over and close a hatch opening on a railroad hopper car. The hatch cover includes a rigid panel sized to cover the hopper car hatch opening. The panel for the hatch cover includes an inner skin, an outer skin, and a core material sandwiched between and adhered to the inner and outer skins. Edge structure is secured to the panel for protecting edges of the panel.

31 Claims, 4 Drawing Sheets

HATCH COVER FOR A RAILROAD HOPPER CAR

FIELD OF THE INVENTION

The present invention generally relates to railroad hopper cars and, more particularly, to a improved hatch cover for releasably closing a hatch opening in a roof of a railroad hopper car.

BACKGROUND OF THE INVENTION

Railroad hopper cars have been used for years to transport particulate and granular material such as grain and the like. Covered railroad hopper cars have been constructed and arranged with a roof for protecting the railcar contents from contaminants and weather related elements. Access to an interior of the railcar from above is through a hatch opening in the roof of the railcar. One type of railcar in wide spread use presents a hatch opening typically extending the length of the railcar. In some railcar designs, the hatch opening can be configured with arcuate end portions. Cowled coaming, upstanding from the roof, typically extends circumferentially or peripherally about the hatch opening.

The hatch opening in the roof of the railcar is closed during transport by a series of individual hatch covers typically arranged in end-to-end relationship relative to each other. The hatch covers are usually pivotally connected to the roof and can be swung to an open position. In one form, each hatch cover can be from eight to thirteen feet in length and weigh approximately 100 pounds. Suffice it to say, the hatch covers are sized to extend across and over a top rim of the coaming to cover the hatch opening. Typically, the hatch covers are releasably secured in a closed position during transport by a series of batten bars and hold downs.

Known hatch covers used to close, hatch openings in covered hopper cars suffer from numerous problems. One form of known hatch cover is formed of fiberglass or other suitable moldable material. Fiberglass hatch covers, however, are susceptible to deteriorating ultraviolet rays and weather related deterioration factors. Fiberglass hatch covers must be designed and manufactured with reinforced profiles for accommodating mounting of several hinge structures along the length thereof to allow pivotal movement of the hatch cover between open and closed positions. As will be appreciated, the need for reinforced profiles adds to the complexity of the hatch cover design. Moreover, the need for high temperatures and pressures in the hatch cover molding process leads to relatively high cost and other obvious problems. Additionally, the molding compound does not readily flow into deep ribs, bosses and related reinforcement areas of the hatch cover. Accordingly, reduced reinforcement and a decreased stiffening effect often results from imperfect formation of the hatch cover.

Another conventional form of hatch cover is manufactured from aluminum or aluminum alloy. While again offering advantageous weight characteristics, the extended length of the hatch cover requires the addition of stiffening or reinforcement members to hatch covers formed from aluminum. Of course, having to add stiffeners and/or reinforcement members adds to the complexity of both the hatch cover design and the manufacturing process and, thus, to the overall cost of the hatch cover. Besides adding steps to the manufacturing process, having to add stiffeners and/or reinforcement members increases the overall weight of the hatch cover. Of course, increasing the weight of the hatch cover converts to added overall weight of the railcar whereby detracting from the carrying capacity of the railcar. Moreover, theft of aluminum hatch covers is a significant concern.

Although specifically directed not to walk across or stand on such railcar hatch covers, it is inevitable workers tend to stand or walk across the closed hatch covers as commodity is added or loaded into the railcar. Accordingly, both those hatch covers formed from aluminum as well as those formed from fiberglass or other suitable material have been structurally designed with a "hat" section profile as an attempt to add strength and stiffness to the hatch cover. As will be appreciated, requiring such a profile adds to the complexity of the hatch cover design along with manufacturing process and, again, adds to the overall cost of the hatch cover. Moreover, the need for such a profile to accomplish rigidity and stiffness increases the weight of the hatch cover whereby detracting from the overall carrying capacity of the railcar.

Thus, there is a continuing need and a desire for a railcar hatch cover which is assembled rather than manufactured, has a simplistic lightweight design, and offers enhanced strength and stiffness over comparable known railcar hatch covers.

SUMMARY OF THE INVENTION

In view of the above, and in accordance with one aspect of the present invention, there is provided a hatch cover adapted to be positioned over a hatch opening on a railroad hopper car. The hatch cover includes a rigid panel sized to cover the hopper car hatch opening. A salient feature of the present invention relates to forming the rigid panel from an inner skin defining a inner major surface for said panel, an outer skin defining an outer major surface for the panel, and a core material sandwiched between and adhered to the inner and outer skins. Edge structure is secured to the panel for protecting exposed edges of the panel against impacts directed against the panel in a direction generally parallel to either major surface of the panel.

In a preferred embodiment, the edge structure has a first portion secured to a peripheral edge of the panel, a second portion extending laterally away from the peripheral edge of the panel, and a third portion for securing the first portion and the second portion in spaced relation relative to each other. In a most preferred form, and to simplify the hatch cover assembly process, the edge structure is adhesively secured to the rigid panel.

Hinge structure is preferably arranged in operable combination with the rigid panel of the hatch cover. As will be appreciated, the hinge structure interconnects the hinge cover to the railcar hopper car and promotes pivotal movement of the hatch cover between open and closed positions relative to the railcar hatch opening. One or more hold downs may also be preferably arranged in operable combination with the rigid panel of the hatch cover.

According to another aspect, there is provided a hatch cover for a railroad hopper car having roof structure defining a hatch opening with upstanding coaming surrounding the hatch opening. With this aspect of the invention, the hatch cover includes a generally rectangular composite panel including an inner skin and an outer skin. The inner skin of the composite panel has an inner surface for facing toward an interior of the railroad hopper car. The outer skin of the composite panel has an exposed outer surf ace. The composite panel further includes a core member extending between the inner skin and outer skin. Edge structure is secured to the composite panel for protecting edges on the composite panel.

In a preferred embodiment, the core member for the composite panel is formed from a polystyrene or other thermoplastic material. Moreover, the rectangularly shaped composite panel includes a pair of laterally spaced sides and a pair of longitudinally spaced ends.

Preferably, the edge structure comprises a pair of elongated side members and a pair of end members secured to the sides and ends of the composite panel, respectively. In one form, each side member of the edge structure includes a first portion arranged in at least partially overlying relation relative to the outer surface of the outer skin of the composite panel, a second portion extending laterally from the respective side of the composite panel, and a third portion interconnecting the first and second portions in spaced relation relative to each other. In a preferred embodiment, the edge structure further includes corners members arranged at a conjuncture of the side members and end members.

The hatch covers adapted to cover end regions of the hatch opening are also preferably provided with a rectangular configuration. Those hatch covers adapted to cover the end regions of the hatch opening are preferably provided with a cover member extending between and cooperating with the edge structure in protecting a gasket preferably associated with the hatch cover. The edge structure of each hatch cover also preferably includes a transversely disposed upstanding ridge extending across an end of the composite panel which is adapted to cooperate with a conventional batten bar for holding the hatch covers in their closed position.

Preferably, the gasket for the hatch cover is adapted to cooperate with the upstanding coaming on the railcar to further inhibit debris from entering the hatch opening. In railcars wherein end portions of the hatch opening and upstanding coaming have an arcuate configuration, the gasket on the hatch cover likewise has, a generally U-shape to match the profile on the railcar. Moreover, and to facilitate pivotal movement of the hatch cover between open and closed positions, the composite panel is adapted to accommodate having hinge structure secured thereto anywhere between the opposed ends of the composite panel.

According to still another aspect, there is provided a hatch cover for a railroad hopper car having roof structure defining a hatch opening with upstanding coaming surrounding the hatch opening. The hatch cover includes a composite panel having laterally spaced and generally parallel sides and generally parallel ends and which is adapted to be movably positioned over the hatch opening in the roof structure. The composite panel includes an inner metal skin and outer metal skin, with the inner metal skin of the composite panel having an inner surface for facing toward an interior of the railroad hopper car. The outer metal skin of the composite panel has an exposed outer surface. The composite panel further includes a plastic core member extending between the inner and outer metal skins. The hatch cover further includes edge structure secured in non-structural surrounding relation relative to and for protecting edges of the composite panel for protecting edges of said composite panel.

In a preferred embodiment, the edge structure includes a pair of extruded side members and a pair of extruded end members secured to the sides and ends of the composite panel, respectively. In one form, the edge structure defines an open-sided channel for accommodating and wherein the sides and ends of said composite panel are secured. Preferably, each side member includes a first portion arranged in at least partially overlying relation relative to the outer surface of the outer metal skin of the composite panel, a second portion extending laterally from the respective side of the composite panel, and a third portion interconnecting the first and second portions in spaced relation relative to each other.

In one form, the edge structure further includes corner members arranged at a conjuncture of the side members and the end members. Regarding those hatch covers adapted to cover end regions of the hatch opening, a cover member is adapted for attachment to the edge structure. Preferably, the edge structure further defines an upstanding ridge adapted to transversely extend across an end of the hatch cover for cooperation with a batten bar on the railroad hopper car.

Preferably, gasket structure seals the hatch cover to the upstanding coaming surrounding the hatch opening on the roof of the hopper car when the hatch cover is closed. In those railcars wherein the end regions of the hatch opening and coaming structure have an arcuate shape or profile, a portion of the gasket can have an arcuate or generally U-shape generally corresponding to the profile of the coaming on the railcar. As will be appreciated, the inner and outer metal skins of the composite panel facilitate the attachment of hinge structure anywhere between the ends of the rigid composite panel.

Accordingly, an object of this invention is to provide an elongated railcar hatch cover which offers increased strength and rigidity whereby allowing the hatch cover to be moved between positions from either end without significant twisting or binding of the hatch cover.

Another object of this invention is to provide a railcar hatch cover which weighs less than comparable known hatch covers, thus, yielding increased carrying capacity for the railcar.

Another object of this invention is to provide a novel railcar hatch cover having a composite panel including a lightweight plastic core sandwiched between two skins whereby adding strength and rigidity to the railcar hatch cover.

Still another object of this invention is to provide a railcar hatch cover which is assembled rather than manufactured.

A further object of this invention is to provide a railcar hatch cover which is simple in construction, economical to produce, and provides a positive seal for the railcar hatch opening when the cover is closed.

These and other objects, aims and advantages of the present invention will become readily apparent from the following detailed description, drawings, and appended claims.

DETAILED DESCRIPTION OF THE INVENTION

Figure 1:
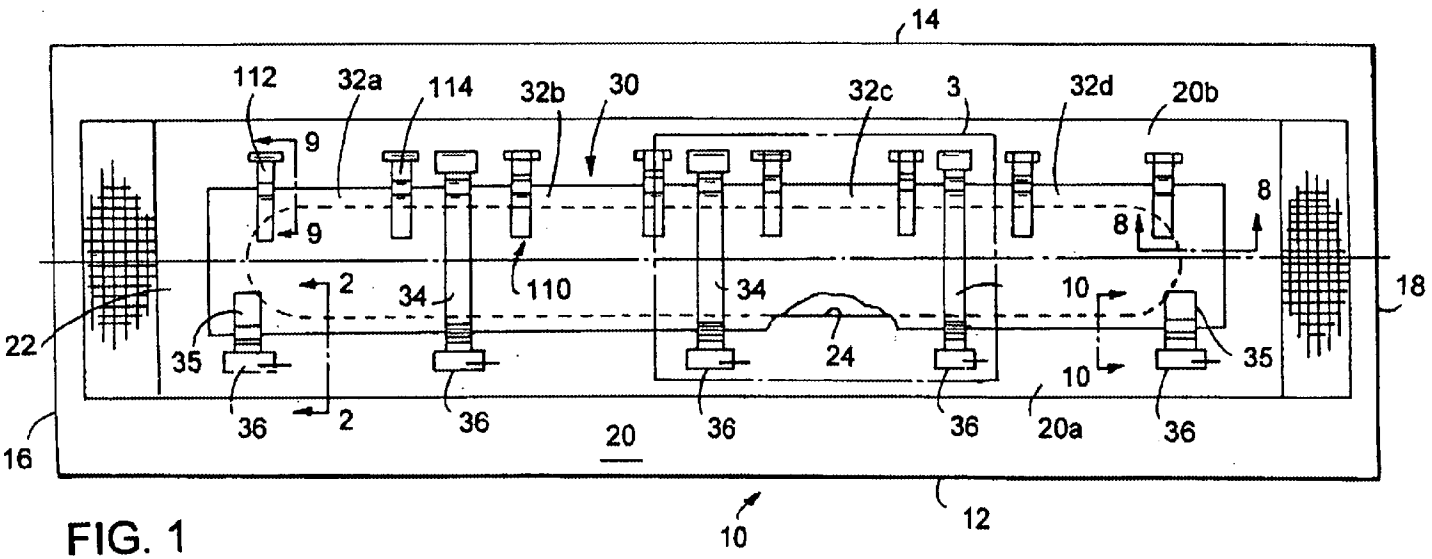
FIG. 1 is a top plan view, partially broken away, of a railroad hopper car and illustrating a hatch cover according to the present invention carried on a roof of the railcar.

While the present invention is susceptible of embodiment in multiple forms, there is shown in the drawings and will hereinafter be described a preferred embodiment of the invention, with the understanding the present disclosure sets forth an exemplification of the invention which is not intended to limit the invention to the specific embodiment illustrated and described.

Referring now to the drawings, wherein like reference numerals indicate like parts throughout the several views, in FIG. 1 a covered railroad hopper car, including features of the present invention, is generally indicated by reference numeral 10. Railcar 10 has a conventional box-like strong and rigid structure including a pair of longitudinally extending and laterally spaced upstanding side walls 12 and 14, a pair of laterally extending and longitudinally spaced upstanding end walls 16 and 18, and a roof 20.

In one form, roof 20 includes a pair of longitudinally extending roof sheets 20*a* and 20*b* respectively disposed laterally on opposite sides of a longitudinal centerline 22 of railcar 10 and respectively sloping laterally and downwardly in opposite directions from the longitudinal centerline 22 of the railcar 10 toward the respective side walls 12, 14. Railcar 10 is adapted for, the transportation of granular material or commodity and has a conventional bottom portion (not shown) which is configured with a plurality of outlets for allowing the granular material or commodity to be discharged from the car 10.

In the illustrated embodiment, railcar 10 has an elongated longitudinally extending hatch opening 24 defined toward a central portion of the roof 20 for loading the granular materials or commodity into the railcar 10. The hatch opening 24 is generally centralized with respect to the longitudinal centerline 22 of the car 10 and has a generally rectangular configuration.

Figure 2:
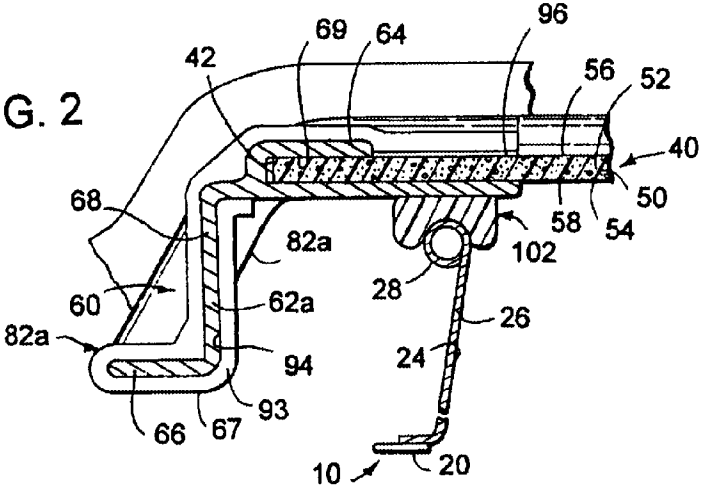
FIG. 2 is a cross-sectional view taken along line 2—2 of FIG. 1.

Turning to FIG. 2, and as is conventional, the hatch opening 24 has hatch coaming 26 extending around the periphery thereof. The coaming 26 is of water-tight construction and is secured in water-tight upstanding relation to the roof 20. As shown, the coaming 26 terminates preferably in a rolled edge portion 28.

Returning to FIG. 1, the hatch opening 24 is covered by a hatch cover assembly 30. In one form, the cover assembly 30 is comprised of a series of longitudinally elongated and aligned hatch covers 32*a*, 32*b*, 32*c*, and 32*d* arranged in end-to-end abutting relation relative to each other. As will be appreciated, the hatch cover assembly 30 can include more or less hatch covers than that shown without detracting or departing from the spirit and scope of the present invention. In the illustrated embodiment, hatch covers 32*a* and 32*d* serve as end hatch covers while hatch covers 32*b* and 32*c* serve as intermediary hatch covers.

The hatch covers 32*a* through 32*d* are adapted to be positioned over and are sized to close the hatch opening 24. In the illustrated embodiment, the covers 32*a* through 32*d* are individually movable between open and closed positions relative to the hatch opening 24 on railcar 10. In one form, the hatch covers 32*a* through 32*d* are removably maintained in a closed position by a series of conventional batten bars 34 and hold downs 35. As known, each batten bar 34 is pivotally secured toward one end to the roof 20 and extends across end regions of the hatch covers. An opposite end of the batten bar 34 is releasably secured to the roof 20 by a conventional latch structure 36 similar to that disclosed in U.S. Pat. No. 4,635,979 to O. E. Blume; the applicable portions of which are incorporated herein by reference. Suffice it to say, and as will be discussed below, each batten bar 34 is constructed such that when secured in place, the batten bars 34 inhibit debris and related contaminants, including the elements of weather, from passing between the abutting ends of the respective covers toward hatch opening 24.

Figure 3:
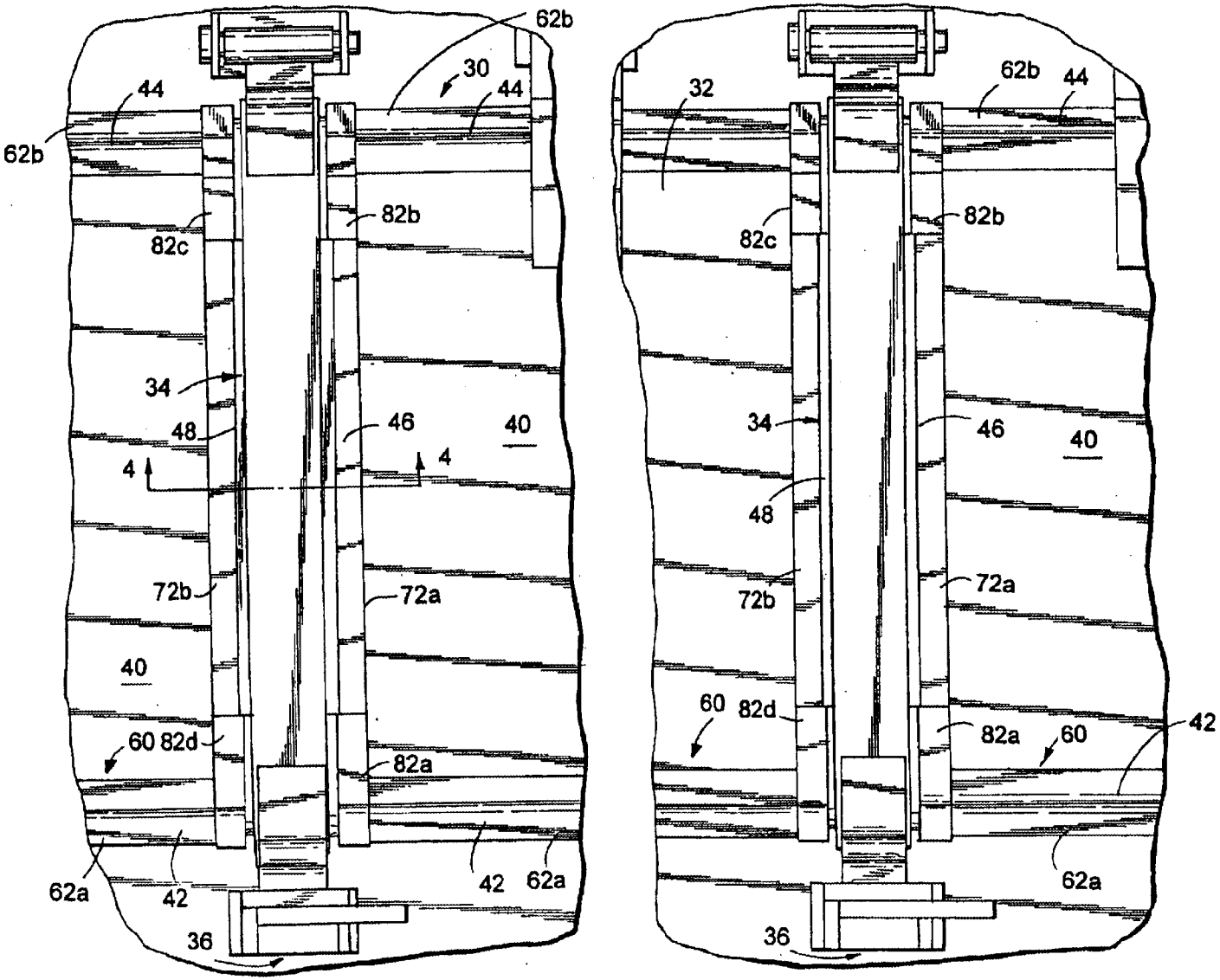
FIG. 3 is a fragmentary enlarged plan view of a the hatch cover shown in the closed boundary line 3 in FIG. 1.

In accordance with the present invention, and as shown in FIG. 3, each hatch cover 32 of the present invention includes a composite panel 40 with edge structure 60 arranged in surrounding relation to the composite panel 40. In the illustrated embodiment, the composite panel 40 forming part of each hatch cover has a generally rectangular and planar configuration including a pair of laterally spaced and generally parallel sides 42 and 44 and a pair of longitudinally spaced and generally parallel ends 46 and 48. Of course, if hatch opening 24 has a different configuration, the composite panel 40 of the hatch cover may likewise have a different configuration, i.e., a configuration which complements the configuration of the hatch opening 24.

Returning to FIG. 2, composite panel 40 is generally planar and includes a core member 50 sandwiched between an outer thin metal skin 52 and an inner thin metal skin 54 and bonded thereto by a suitable well known adhesive or other like means. As shown, the outer metal skin 52 defines a major surface 56 for facing toward the outside of the car 10 and which is exposed to the elements while the inner skin 54 defines a major surface 58 for facing toward an interior of the railcar 10. Both the outer and inner surfaces 56 and 58, respectively, are suitably treated, i.e. powder coated or otherwise finished. Moreover, a suitable treatment for enhancing traction for workers can be added to the outer surface 56 of the outer skin 52. In a preferred form, the core member 50 is made from a non-metal material, preferably thermoplastic, such as polypropylene, or high density polyethylene. These materials are relatively inexpensive as compared to aluminum found in prior hatch cover constructions. In addition, and because a composite panel is used, the weight of the hatch cover is reduced over comparable prior art hatch covers.

The metal skins 52 and 54 add strength, stiffness and rigidity to the composite panel 40 while their minimal thickness reduces the weight of the hatch cover 32. In one form, the metal skins 52 and 54 are each preferably approximately 0.026 inches thick. The skins 52, 54 are preferably formed from galvanized, full hardened steel, such as AISI Grade E full hard steel because of its cost effectiveness, or the like. In another form, the outer skin 52 is made of ASTM G90 galvanized steel and the inner skin 54 is made of ASTM G60 galvanized steel. Aluminum may also be used, but it may be too soft for some purposes and strength and punch resistence are sacrificed. Aluminum, however, is light weight.

Edge structure 60 is secured to and protects exposed edges of the panel 40 against stones and related debris impacting against panel 40 in a direction extending generally parallel to either of the panel's major surfaces 56 and 58.

Preferably, and to facilitate assembly rather than manufacture of the hatch cover 32, edge structure 60 is preferably adhesively secured to the composite panel 40. Edge structure 60 is; preferably configured, however, such that one or more pull rivets can supplement the securement of the composite panel 40 and structure 60. Moreover, the edge structure 60 is secured in non-structural surrounding relation relative to the composite panel 40. As used herein, the tern "non-structural" means there is no load carried or transmitted by the edge structure 60 when the hatch cover 32 is in a closed position. Instead, strength and rigidity for each hatch cover 32*a* through 32*d* are derived from the composite panel.

In one form, edge structure 60 includes a pair of laterally spaced side members 62*a* and 62*b* (FIG. 3). To reduce inventory and costs, the side members 62*a* and 62*b* of edge structure 60 are preferably identical and, thus, only side member 62*a* will be discussed in detail whereby providing a complete understanding of both side members 62*a* and 62*b*. In one form, and to simplify fabrication thereof, each side member of edge structure 60 is preferably formed as an extrusion. While almost any material subject to an extrusion process will suffice, in a most preferred form, each side member of edge structure is formed as an aluminum extrusion to minimizing the weight of the respective hatch cover.

As illustrated in FIG. 2, each side member of edge structure 60 includes a first portion 64, a second portion 66, and a third portion 68. The first portion 64 of each side member is arranged in at least partially overlying relation relative to the outer surface 56 of the composite panel 40 and is preferably configured to facilitate securement of the composite panel and the side members of edge structure 60 relative to each other. As shown, the second portion 66 of each side member extends laterally away from a respective side of the composite panel 40 and serves as a handle which can be readily grasped when the hatch cover 32 is to be moved from a closed toward an open position. Moreover, the second portion 66 defines a lower edge 67 of the edge structure 60. The third portion 68 of the side member of edge structure 60 interconnects the first and second portions 64 and 66, respectively, of the side member in spaced relation relative to each other.

In the form illustrated in FIG. 2, each side member of the edge structure 60 defines a longitudinally elongated open sided channel 69 defined by the first portion 64 of the side member for accommodating the respective side perimeter of the composite panel 40. Preferably, channel 69 is sized only slightly larger than the width of and allows both surfaces 56 and 58 at the side perimeter of the composite panel 40 to be captured and adhesively secured to the first portion of the side member of edge structure 60. As such, and after the composite panel 40 is adhesively secured to the side members of edge structure 60, the composite panel 40 will be in double shear due to the preferred design of the edge stricture 60.

As shown in FIG. 3, the edge structure 60 for each hatch cover 32 further includes a pair of longitudinally spaced end members 72*a* and 72*b*. To reduce inventory and costs, the end members 72*a* and 72*b* of edge structure 60 are preferably identical. Thus, only end member 72*b* will be discussed in detail whereby providing a complete understanding of both end members 72*a* and 72*b*. Preferably, and to simplify fabrication thereof, each end member of edge structure 60 is preferably formed as an extrusion. While almost any material subject to an extrusion process will suffice, in a most preferred form, each end member of edge structure 60 is formed as an aluminum extrusion to minimize the weight of the respective hatch cover.

Figure 4:
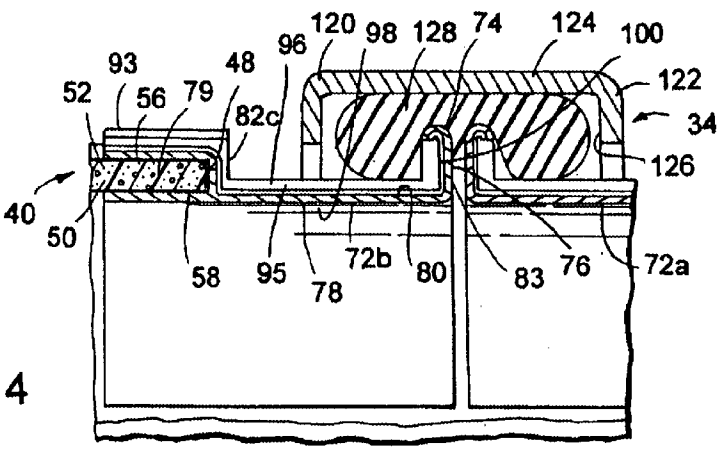
FIG. 4 is a sectional view taken along line 4—4 of FIG. 3.

As illustrated in FIG. 4, one end of each end member of edge structure 60 on the hatch cover 32 defines an upstanding ridge or coaming 74 and an end wall 76 laterally extending across a major portion of the end member. Each end member of the edge structure 60 on each hatch cover 32 also includes an intermediary section 78 extending longitudinally inwardly from the end wall 76. At an opposite end, each edge structure end member defines a laterally elongated open sided channel 79 for accommodating a respective end perimeter of the composite panel 40.

In the illustrated embodiment, the upstanding ridge or coaming 74, the intermediary section 78, along with the channel end 79 preferably combine to provide each end member with a generally U-shape cross-sectional configuration. Moreover, and when the hatch cover 32 is assembled, the channels 69 and 79 defined by the side members 62*a*, 62*b* and end members 72*a*, and 72*b*, respectively, of edge structure 60 are disposed in generally coplanar relationship relative to each other. Preferably, channel 79 is sized only slightly larger than the width of and allows both surfaces 56 and 58 at the end perimeter of the composite panel 40 to be captured and adhesively secured therewithin. As such, and after the composite panel 40 is adhesively secured to the end members of edge structure 60, the composite panel 40 will be in double shear due to the preferred design of the edge structure 60.

In the embodiment illustrated in FIG. 3, the edge structure 60 of each hatch cover 32 furthermore includes corner members 82*a* through 82*d* arranged at the conjuncture of the side members 62*a*, 62*b* and end members 72*a*, 72*b*. The corner members of edge structure 60 are configured to cooperate with the side members 62*a*, 62*b* and end members 72*a*, 72*b* in inhibiting damage to the edges of the composite panel.

As will be appreciated, the corner members 82*a* through 82*d* of the edge structure 60 are arranged in pairs relative to each other. That is, corner members 82*a* and 82*c* form one pair while members 82*b* and 82*d* form a second pair of corner members which are mirror images of the first pair of corner members. To reduce inventory and costs, each pair of corner members of edge structure 60 are preferably identical.

Because of the substantial similarity therebetween, only corner member 82*c* will be discussed in detail whereby providing a complete understanding of the other corner members 82*a*, 82*b* and 82*d*. In one form each corner member of the edge structure 60 is preferably formed from aluminum to minimize the weight of the respective hatch cover. Alternatively, the corner members forming part of edge structure 60 can be formed from fiberglass or other suitable lightweight composite materials.

Figure 6:
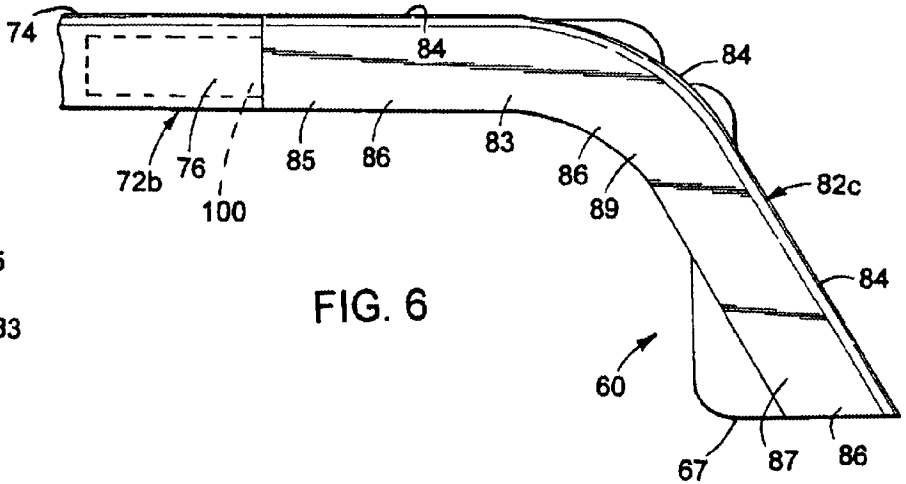
FIG. 6 is an enlarged end view of another portion of edge structure forming part of the present invention.
Figure 5:
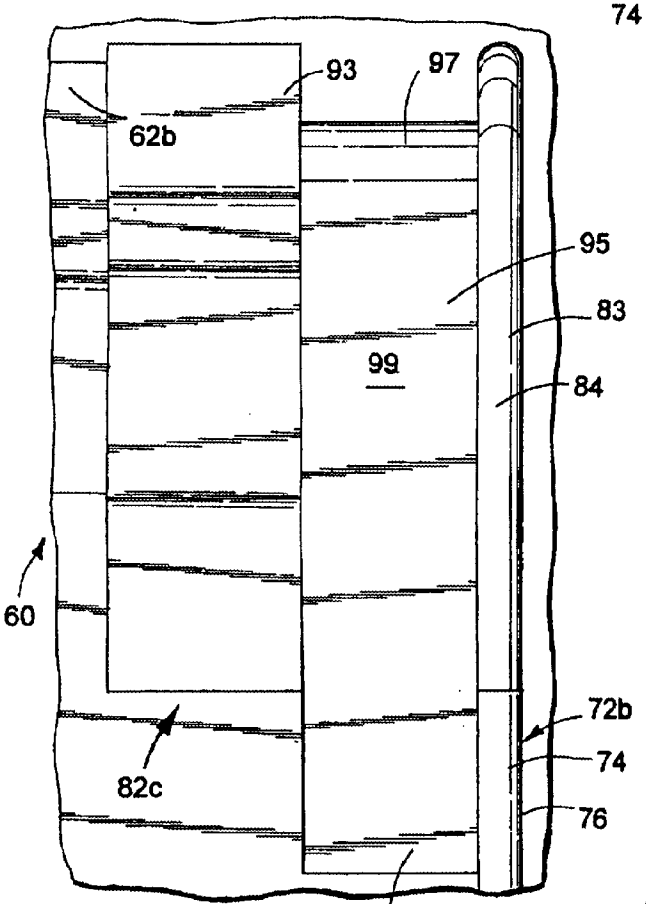
FIG. 5 is an enlarged plan view of a corner portion of a hatch cover embodying one form of the present invention.

In one form, each corner member of edge structure 60 has a plurality of longitudinally spaced portions integrally joined to each other. As shown in FIGS. 5 and 6, the first portion 83 of each corner member includes an upstanding ridge or coaming 84 and an end wall 86 extending across a major transverse length of the corner member. As illustrated in FIGS. 2, 5 and 6, when the hatch cover 32 is assembled, a region 85 of the upstanding ridge or coaming 84 on the end cover extends in aligned relationship with the upstanding ridge or coaming 74 on a respective end member of the edge structure 60 whereby operably providing a substantially continuous and generally linear upstanding ridge-like configuration transversely across ends of the hatch cover. An integrally formed second region 87 of each corner member, likewise configured with a continuation of the upstanding ridge or coaming 84 and end wall 86, is disposed in an angular downward disposition relative to region 85 of the corner member and extends to the lower edge 67 of the edge structure 60. Preferably, a curved region 89, likewise configured with a continuation of the upstanding ridge or coaming 84 and end wall 86, joins the first and second regions 85 and 87, respectively, of each corner member. Suffice it to say, when the hatch cover is assembled, the configuration of the corner members along with the design of the respective end member provide the end section of the edge structure 60 with a configuration complementary to a profile of the hold down bar or batten 34 to be arranged in operable combination therewith.

In the embodiment illustrated in FIGS. 2 and 6, a second portion 93 is integrally provided toward an opposed longitudinal end of each corner member. Notably, the second portion 93 of each corner member is adequately and longitudinally spaced from the first portion 83 as to not interfere with closure of the batten bar 34 relative to the hatch cover. The second portion 93 of each corner member is preferably configured to secure a lengthwise portion of an end of a respective side member 62 of the edge structure 60 thereto. In a preferred form, and as shown in FIG. 2, the second portion 93 of each corner member defines an open sided channel 94 which is configured to accommodate a lengthwise portion of an end of a respective side member 62 of the edge structure therewithin. Preferably, a suitable adhesive secures a lengthwise portion of an of the respective side member 62 of structure within the channel 94 of the cover member. Of course, and if so desired, suitable fastening means i.e., a threaded fastener, could be used in the alternative or as a supplement to the adhesive.

Preferably, and as shown in FIG. 5, an intermediary portion 95 rigidly interconnects the first and second portions 83 and 93, respectively, of the corner member to each other. Like the first portion 83 of each corner member, the intermediary portion 95 includes a first region 96 having a generally planar transverse or laterally extending configuration and an integrally formed generally planar second region 97. The second region 97 of each corner member is disposed in an angular downward disposition relative to region 95 of the corner member and extends to the lower edge 67 of the edge structure 60. A curved region 99 preferably joins the first and second regions 96 and 97, respectively, of each corner member. As shown in FIG. 4, the first portion 83, second portion 93, and the intermediary portion 95 preferably combine with other to provide each corner member of the edge structure with a generally U-shape cross-sectional configuration.

Preferably, and as shown in FIG. 4, the corner members of edge structure 60 disposed at a common end of the hatch cover furthermore support a respective end member 72 therebetween. In one form, and to add to the simplicity of assembly, an upper surface 80 on the intermediary section 78 of the end members is secured, preferably by adhesive, to a lower or undersurface of the first region 96 on the intermediary portion 95 on the corner members. Moreover, and to add further structural integrity to the edge structure 60, the coaming 74 provided on each end member is preferably structured and designed to extend for a predetermined transverse length along and about and, preferably is adhesively secured to, appropriately configured structure 100 on those corner members arranged at opposite ends of the respective end member supported thereby.

Figure 8:
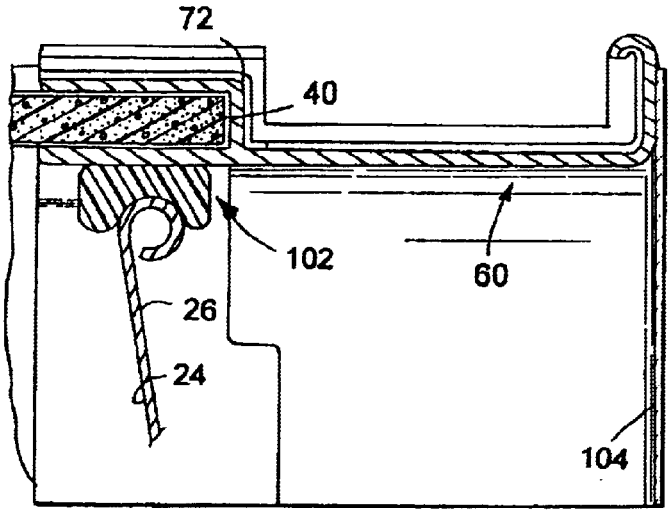
FIG. 8 is an enlarged sectional view taken along line 8—8 of FIG. 1.

Returning to FIG. 2, each hatch cover furthermore preferably includes a gasket 102. Preferably, gasket 102 is a neoprene gasket secured by adhesive or the like to an underside of each hatch cover. In a preferred embodiment, and as shown in FIGS. 2 and 8, gasket 102 is preferably adhesively secured to the underside of the edge structure 60 to facilitate replacement of the gasket 102. Gasket 102 is positioned to effect a tight seal against the rolled edge or roof coaming 26 when the hatch cover is closed. Gasket 102 is designed to deform against the edge portion 26 in order to provide a tight seal whereby preventing moisture, debris and foreign material from contaminating the commodity or other contents of the car 10.

In some designs, and as schematically represented in FIG. 1, the hatch opening 24 in the car 10 has arcuately shaped end regions. With such a hatch opening design, and understanding coaming 26 can also have an arcuate configuration at the end regions of the hatch opening 24, gasket 102 can be readily designed and/or, configured such that the gasket formation on the hatch cover matches the configuration of the curved coaming 26 on railcar 10.

Figure 7:
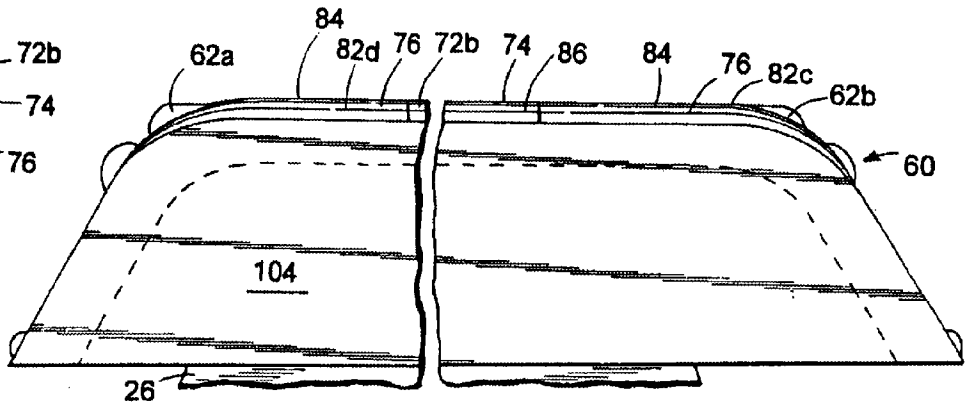
FIG. 7 is a fragmentary end view of an end of one form of hatch cover.

In the illustrated embodiment, hatch covers 32*a* and 32*d* serve as end hatch covers which fit over and cover end regions of the hatch opening 24. As will be appreciated, and as end hatch covers, one end of each has no adjoining hatch cover to abut thereagainst. Accordingly, and as shown in FIGS. 7 and 8, the edge structure 60, arranged toward the end of the hatch cover having no adjoining hatch cover arranged in abutting relationship therewith, is preferably provided with a cover 104. In one form, cover 104 is configured with a simple plate configuration and is secured to and depends from the end walls 76 of the corners members and the end wall 86 of the end member forming that part of the edge structure 60 disposed toward a respective end of the hatch cover. As shown, in a preferred form, the cover plate 104 depends toward and terminates at a lower end 67 of the edge structure 60. Preferably, and to facilitate the assembly process, the cover plate 104 is adhesively secured to the end walls 76 of the corners members and the end wall 86 of the end member but it will be appreciated any suitable fastening means, i.e., threaded fasteners or the like, would equally suffice for the intended purpose. Like the other depending sections of the edge structure 60, a primary purpose of the cover plate 104 is to protect the neoprene gasket 102 (FIG. 2) against exposure to ultraviolet rays and related weather elements.

Figure 9:
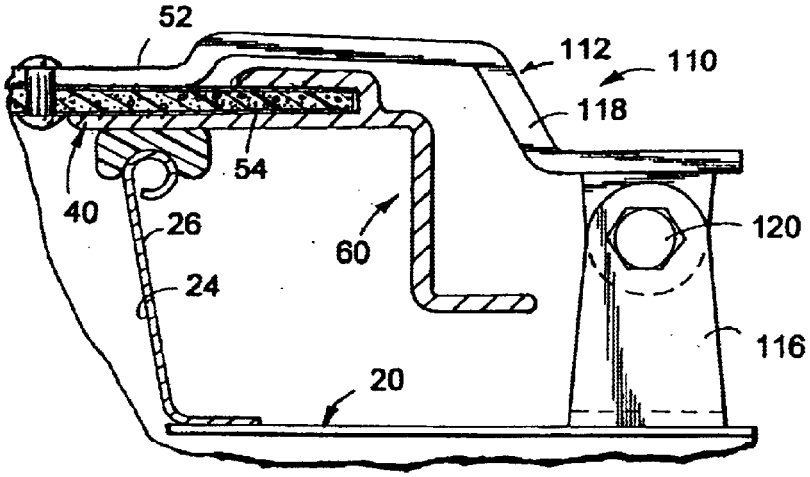
FIG. 9 is a sectional view taken along line 9—9 of FIG. 1.

As illustrated in FIGS. 1 and 9, each hatch cover 32 is mounted to the roof 20 of the railcar 10 for pivotal movements between open and closed positions by hinge structure 110. In one form, hinge structure 110 includes a pair of longitudinally spaced hinges 112 and 114 secured to each hatch cover 32. The hinges 112 and 114 are substantially identical to each other and, thus, only hinge 112 will be discussed in detail. In the embodiment illustrated in FIG. 9, each hinge includes a first element 116, rigidly secured to the railcar roof 20, and a second element 118 secured to each respective hatch cover 32. A suitable element 120 pivotally interconnects the elements 116 and 118 to each other. Accordingly, each hatch cover is mounted upon the individual pair of hinges 112 and 114 of hinge structure 110 for pivotal movements with respect to the hatch opening 24 in the railcar 10.

As shown in FIG. 9, the end of each hinge element 118 opposite from its articulate connection to the railcar 10 is secured by any suitable means, i.e., threaded fastener, rivets or the like which pass through the opposite sides of the composite panel 40. In this regard, the thin metal skins 52 and 54 on the composite panel 40 advantageously allow the hinge elements 118 to be secured substantially anywhere along the length of the composite panel 40. That is, the metal skins 52, 54 forming part of the composite panel eliminate the heretofore required need to bolster the cross-sectional thickness of the hatch cover in this areas wherein the hinge structure was to be secured thereto. As such, the composite panel structure 40 provided in combination with the hatch cover of the present invention provides advantageous design freedom regarding the various locations positions whereat the hinge structure 110 is required to be fastened to the hatch covers.

As illustrated in FIG. 4, each batten bar 34 is integrally formed with a pair of spaced arms 120 and 122 and a cross-member 124 which combine to define a channel 126 extending substantially the length of the batten bar 34. Moreover, each batten bar 34 furthermore includes a resilient sealing gasket 128 carried within and spanning substantially the width of the channel 126. As should be appreciated from above, the preferred design extending transversely across the end region of the edge structure 60 on each hatch cover facilitates sealing engagement between the edge structure 60 and the batten gasket seal 128 when the hatch cover is closed.

FIG. 4 illustrates a centralized portion of the gasket seal 128 engaging the upstanding end flange structure or ridge on the edge structure 60 at the end of the hatch cover while side portions of the gasket seal 128 sealing engage the end walls of the edge structure 60 and tend to flow into the intermediary or second U-shape regions of the end members and corner members of the edge structure 60. As such, not only does the ridge formation or structure extending transversely across each end of the edge structure 60 engage and seal against the gasket 128, but also the gasket 128 seals against the end wall structure 76 transversely extending across the end of the edge structure 60 when the hatch cover is closed whereby enhancing sealing of the hatch cover and, thus, inhibiting moisture, other weather related elements, and contaminants from moving past the seal 128 into the railcar hatch opening 26.

Figure 10:
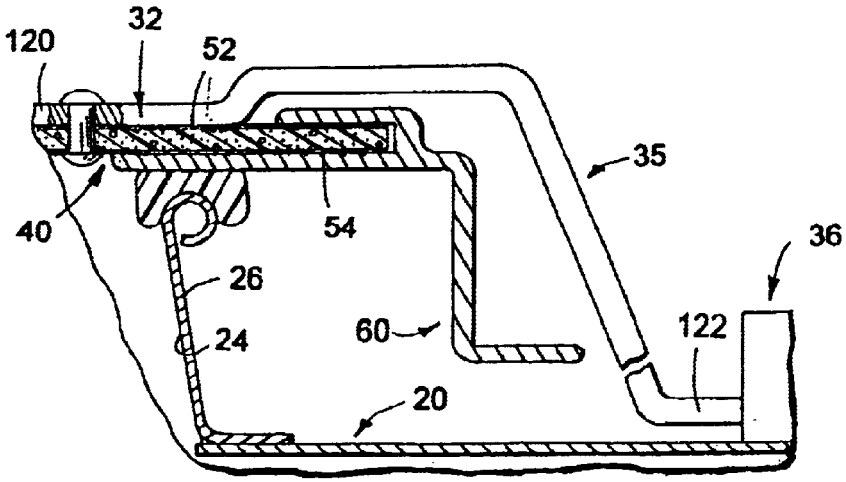
FIG. 10 is a sectional view taken along line 10—10 of FIG. 1.

As shown in FIG. 1, the roof 20 of the railcar 10 may not always allow a batten bar 34 to be properly positioned at the end of a hatch cover. Accordingly, one or more of the hatch covers can be provided with a hold down 35. As shown in FIG. 10, each hold down 35 is provided with a first end 120 secured between opposed ends of the hatch cover 32 and a second end 122 which is configured to be releasably secured to conventional latch structure 36 as discussed above. Intermediate its ends 120, 122 each hold down is configured to extend from an upper portion of the hatch cover 32, toward roof 20, and into operable association with the latch structure 36.

As shown in FIG. 10, the first end 120 of each hold down 35 is secured by any suitable means, i.e., threaded fastener, rivets or the like which pass through the opposite sides of the composite panel 40. In this regard, the thin metal skins 52 and 54 on the composite panel 40 advantageously allow the hold downs 35 to be secured substantially anywhere along the length of the composite panel 40. That is, the metal skins 52, 54 forming part of the composite panel eliminate the heretofore required need to bolster the cross-sectional thickness of the hatch cover in those areas wherein the hold downs are to be secured thereto. As such, the composite panel structure 40 provided in combination with the hatch cover of the present invention furthermore provides advantageous design freedom regarding the locations whereat the hold downs 35 are required to be fastened to the hatch covers.

The hatch cover of the present invention offers other advantages. First, the hatch cover of the present invention is considerably lighter in weight than comparable conventional hatch covers. The reduced weight offered by the hatch covers of this invention readily translates into allowing the railcar to carry more commodity, thus, improving railcar efficiency. The lightweight panel forming a major component of the hatch clover relies on composite technology to advantageously achieve results which have been heretofore unachieved. In this regard, the hatch cover of the present invention is at least 20% lighter than comparably sized conventional hatch covers. Second, the hatch cover of the present invention is considerably stiffer than comparable hatch covers. The stiffness yielded by the composite technology hatch cover of the present invention has eliminated the need for separate reinforcing bars and the "hat" section profile normally associated with railcar hatch covers. Moreover, the simplified planar configuration of the composite panel has reduced the weight of the hatch cover form comparably sized hatch covers, thus, advantageously yielding increased load carrying capacity for the railcar.

As mentioned above, one important aspect of the present invention is that it provides a hatch cover design which is assembled rather than manufactured. If required, assembly of the hatch cover of the present invention can be readily affected with tools available at installation sites, such tools being metal working tools, i.e., metal cutting saws, and conventional adhesives. With the present invention, no welding is required to assemble the hatch cover. Of course, assembly rather than manufacture of the hatch cover avoids close tolerances between matching parts to be assembled and allows for greater variations in installation techniques from railcar to railcar. Moreover, rather than requiring one set of intermediary hatch covers adapted to be arranged in abutting end-to-end relation and a separate or second set of hatch covers for railcars having arcuate shaped end regions, the hatch cover of the present invention offers a modular design which readily adapts for use as either an intermediary hatch cover or an end hatch cover regardless of the configuration of the hatch opening in the railcar.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A hatch cover adapted to be positioned over a hatch opening on a railroad hopper car, said hatch cover comprising:

a rigid panel sized to cover the hatch opening on the hopper car, said rigid panel including an inner skin defining an inner major surface for said panel, and an outer skin arranged in spaced relation from said inner panel and defining an outer major surface for said panel, and plastic core material between and adhered to confronting surfaces on said inner skin and said outer skin; and edge structure secured to said rigid panel for protecting terminal edges of said rigid panel against impacts directed against said panel in a direction extending generally parallel to either major surface of said panel.

2. The hatch cover according to claim 1 further including hinge structure for securing said hatch cover to said hopper car for pivotal movement between an open and a closed position.

3. The hatch cover according to claim 1 further including a gasket for sealing said hatch opening when said hatch cover is in the closed position.

4. The hatch cover according to claim 1 further including at least one hold down bar having a first portion secured to said rigid panel and a second portion extending laterally from a side of said hatch cover.

5. The hatch cover according to claim 1 wherein said rigid panel has a generally rectangular and planar configuration including opposed sides and opposed ends.

6. A hatch cover adapted to be positioned over a hatch opening on a railroad hopper car, said hatch cover comprising:

a rigid panel sized to cover the hatch opening on the hopper car, said rigid panel including an inner skin defining an inner major surface for said panel, and an outer skin defining an outer major surface for said panel, and plastic core material sandwiched between and adhered to said inner skin and said outer skin; and edge structure secured to said rigid panel for protecting edges of said rigid panel against impacts directed against said panel in a direction extending generally parallel to either major surface of said panel, wherein said edge structure has a first portion secured to a peripheral edge of said panel, a second portion extending laterally away from the peripheral edge of said panel, and a third portion for securing said first portion and second portion in vertically spaced relation relative to each other.

7. A hatch cover adapted to be positioned over a hatch opening on a railroad hopper car, said hatch cover comprising:

a rigid panel having a generally rectangular and planar configuration including opposed sides and opposed ends and which is sized to cover the hatch opening on the hopper car, said rigid panel including an inner skin defining an inner major surface for said panel, and an outer skin defining an outer major surface for said panel, and plastic core material sandwiched between and adhered to said inner skin and said outer skin; and edge structure secured to said rigid panel for protecting edges of said rigid panel against impacts directed against said panel in a direction extending generally parallel to either major surface of said panel, and wherein said edge structure is adhesively secured to said opposed sides and said opposed ends of the rigid panel.

8. A hatch cover for a railroad hopper car having roof structure defining a hatch opening with upstanding coaming surrounding said hatch opening, said hatch cover comprising:

a generally rectangular composite panel including an inner metal skin and an outer metal skin, with said inner skin of said composite panel having an inner surface for facing toward an interior of said railroad hopper car, and wherein said outer skin of said composite panel is spaced from said inner skin and has an exposed outer surface, and wherein said composite panel further includes a core member between and adhered to confronting surfaces on said inner skin and outer skin;

edge structure secured to said composite panel for protecting terminal edges on said panel.

9. The hatch cover according to claim 8 wherein said core member of said composite panel is formed from a thermoplastic material.

10. The hatch cover according to claim 8 wherein said composite panel includes a pair of laterally spaced sides and a pair of longitudinally spaced ends.

11. The hatch cover according to claim 10 further including a hold down having a first end, secured to said rigid panel, and a second end, extending laterally from a side of said hatch cover.

12. The hatch cover according to claim 8 wherein said edge structure comprises a pair of elongated side members and a pair of end members secured to the sides and ends of said composite panel, respectively.

13. The hatch cover according to claim 8 further including a gasket for cooperating with said upstanding coaming on said railroad hopper car to seal said hatch opening when said hatch cover is in the closed position.

14. A hatch cover for a railroad hopper car having roof structure defining a hatch opening with upstanding coaming surrounding said hatch opening, said hatch cover comprising:

a generally rectangular composite panel including an inner skin and an outer skin, with said inner skin of said composite panel having an inner surface for facing toward an interior of said railroad hopper car, and wherein said outer skin of said composite panel has an exposed outer surface, and wherein said composite panel further includes a core member extending between said inner skin and outer skin; and edge structure secured to said composite panel for protecting edges on said panel, wherein said edge structure defines an open sided channel configured to accept an edge of said composite panel therewithin.

15. A hatch cover for a railroad hopper car having roof structure defining a hatch opening with upstanding coaming surrounding said hatch opening, said hatch cover comprising:

a generally rectangular composite panel including an inner skin and an outer skin, with said inner skin of said composite panel having an inner surface for facing toward an interior of said railroad hopper car, and wherein said outer skin of said composite panel has an exposed outer surface, and wherein said composite panel further includes a core member extending between said inner skin and outer skin; and edge structure secured to said composite panel for protecting edges on said panel, with said edge structure comprising a pair of elongated side members and a pair of end members secured to the sides and ends of said composite panel, respectively, and wherein said elongated side members and said end members are adhesively secured to the sides and ends of said composite panel, respectively.

16. A hatch cover for a railroad hopper car having roof structure defining a hatch opening with upstanding coaming surrounding said hatch opening, said hatch cover comprising:

a generally rectangular composite panel including an inner skin and an outer skin, with said inner skin of said composite panel having an inner surface for facing toward an interior of said railroad hopper car, and wherein said outer skin of said composite panel has an exposed outer surface, and wherein said composite panel further includes a core member extending between said inner skin and outer skin; and edge structure secured to said composite panel for protecting edges on said panel, with said edge structure comprising a pair of elongated side members and a pair of end members secured to the sides and ends of said composite panel, respectively, and wherein each side member includes a first portion arranged in at least partially overlying relation relative to the outer surface of the outer skin of said panel, a second portion extending laterally from the respective side of said panel, and a third portion interconnecting said first and second portions in spaced relation relative to each other.

17. A hatch cover for a railroad hopper car having roof structure defining a hatch opening with upstanding coaming surrounding said hatch opening, said hatch cover comprising:

a generally rectangular composite panel including an inner skin and an outer skin, with said inner skin of said composite panel having an inner surface for facing toward an interior of said railroad hopper car, and wherein said outer skin of said composite panel has an exposed outer surface, and wherein said composite panel further includes a core member extending between said inner skin and outer skin; and edge structure secured to said composite panel for protecting edges on said panel, with said edge structure comprising a pair of elongated side members and a pair of end members secured to the sides and ends of said composite panel, respectively, and wherein said edge structure further includes corner members arranged at a conjuncture of said side members and said end members.

18. The hatch cover according to claim 17 further including a cover adapted for attachment to the corner members at one end of said composite panel.

19. A hatch cover for a railroad hopper car having roof structure defining a hatch opening with upstanding coaming surrounding said hatch opening, said hatch cover comprising:

a generally rectangular composite panel including an inner skin and an outer skin, with said inner skin of said composite panel having an inner surface for facing toward an interior of said railroad hopper car, and wherein said outer skin of said composite panel has an exposed outer surface, and wherein said composite panel further includes a core member extending between said inner skin and outer skin; and edge structure secured to said composite panel for protecting edges on said panel, wherein said edge structure defining an upstanding ridge transversely extending across an end of said hatch cover and adapted for cooperation with a batten bar on said railroad hopper car.

20. A hatch cover for a railroad hopper car having roof structure defining a hatch opening with upstanding coaming surrounding said hatch opening, said hatch cover comprising:

a generally rectangular composite panel including an inner skin and an outer skin, with said inner skin of said composite panel having an inner surface for facing toward an interior of said railroad hopper car, and wherein said outer skin of said composite panel has an exposed outer surface, and wherein said composite panel further includes a core member extending between said inner skin and outer skin;

edge structure secured to said composite panel for protecting edges on said panel, and a gasket cooperating with said upstanding coaming on said railroad hopper car for sealing said hatch opening when said hatch cover is in the closed position, and wherein a portion of said gasket has an arcuate generally U-shape to match a profile of said upstanding coaming on the railroad hopper car.

21. A hatch cover for a railroad hopper car having roof structure defining a hatch opening with upstanding coaming surrounding said hatch opening, said composite hatch cover comprising:

a composite panel having laterally spaced and generally parallel sides and generally parallel, longitudinally spaced ends and which is adapted to be movably positioned over the hatch opening in the roof structure, said composite panel including an inner metal skin and outer metal skin arranged in spaced and generally parallel relation relative to each other between the opposed sides and opposed ends of said panel, with said inner metal skin of said composite panel having an inner surface for facing toward an interior of said railroad hopper car, and with the outer metal skin of said composite panel having an exposed outer surface, with said composite panel further including a plastic core member between and adhered to said inner metal skin and outer metal skin; and edge structure secured in non-structural surrounding relation relative to said panel for protecting terminal edges of said composite panel.

22. The hatch cover according to claim 21 further including a hold down having a first end secured to said composite panel and a second end extending laterally from one side of said hatch cover.

23. The hatch cover according to claim 21 wherein said edge structure comprises a pair of extruded side members and a pair of extruded end members secured to the sides and ends of said composite panel, respectively.

24. The hatch cover according to claim 21 further including gasket structure for sealing said hatch cover to the upstanding coaming surrounding the hatch opening on the roof of said hopper car when said hatch cover is closed.

25. A hatch cover for a railroad hopper car having roof structure defining a hatch opening with upstanding coaming surrounding said hatch opening, said composite hatch cover comprising:

a composite panel having laterally spaced and generally parallel sides and generally parallel, longitudinally spaced ends and which is adapted to be movably positioned over the hatch opening in the roof structure, said composite panel including an inner metal skin and outer metal skin, with said inner metal skin of said composite panel having an inner surface for facing toward an interior of said railroad hopper car, and with the outer metal skin of said composite panel having an exposed outer surface, with said composite panel further including a plastic core member extending between said inner metal skin and outer metal skin; and edge structure secured in non-structural surrounding relation relative to said panel, and wherein said edge structure defines a channel for accommodating and wherein side and end edges of said composite panel are secured.

26. A hatch cover for a railroad hopper car having roof structure defining a hatch opening with upstanding coaming surrounding said hatch opening, said composite hatch cover comprising:

a composite panel having laterally spaced and generally parallel sides and generally parallel, longitudinally spaced ends and which is adapted to be movably positioned over the hatch opening in the roof structure, said composite panel including an inner metal skin and outer metal skin, with said inner metal skin of said composite panel having an inner surface for facing toward an interior of said railroad hopper car, and with the outer metal skin of said composite panel having an exposed outer surface, with said composite panel further including a plastic core member extending between said inner metal skin and outer metal skin; and edge structure secured in non-structural surrounding relation relative to said panel, with said edge structure including a pair of extruded side members and a pair of extruded end members secured to the sides and ends of said composite panel, respectively, and wherein each side member includes a first portion arranged in at least partially overlying relation relative to the outer surface of the outer metal skin of said composite panel, a second portion extending laterally from the respective side of said composite panel, and a third portion interconnecting said first and second portions in spaced relation relative to each other.

27. A hatch cover for a railroad hopper car having roof structure defining a hatch opening with upstanding coaming surrounding said hatch opening, said composite hatch cover comprising:

a composite panel having laterally spaced and generally parallel sides and generally parallel, longitudinally spaced ends and which is adapted to be movably positioned over the hatch opening in the roof structure, said composite panel including an inner metal skin and outer metal skin, with said inner metal skin of said composite panel having an inner surface for facing toward an interior of said railroad hopper car, and with the outer metal skin of said composite panel having an exposed outer surface, with said composite panel further including a plastic core member extending between said inner metal skin and outer metal skin; and edge structure secured in non-structural surrounding relation relative to said panel, with said edge structure including a pair of extruded side members and a pair of extruded end members secured to the sides and ends of said composite panel, respectively, and wherein said edge structure further includes corner members arranged at a conjuncture of said side members and said end members.

28. The hatch cover according to claim 27 further including a cover adapted for attachment to the corner members of said edge structure at one end of said composite panel.

29. A hatch cover for a railroad hopper car having roof structure defining a hatch opening with upstanding coaming surrounding said hatch opening, said composite hatch cover comprising:

a composite panel having laterally spaced and generally parallel sides and generally parallel, longitudinally spaced ends and which is adapted to be movably positioned over the hatch opening in the roof structure, said composite panel including an inner metal skin and outer metal skin, with said inner metal skin of said composite panel having an inner surface for facing toward an interior of said railroad hopper car, and with the outer metal skin of said composite panel having an exposed outer surface, with said composite panel further including a plastic core member extending between said inner metal skin and outer metal skin; and edge structure secured in non-structural surrounding relation relative to said panel, and wherein said edge structure defines an upstanding ridge transversely extending across an end of the hatch cover and adapted for cooperation with a batten bar on said railroad hopper car.

30. A hatch cover for a railroad hopper car having roof structure defining a hatch opening with upstanding coaming surrounding said hatch opening, said composite hatch cover comprising:

a composite panel having laterally spaced and generally parallel sides and generally parallel, longitudinally spaced ends and which is adapted to be movably positioned over the hatch opening in the roof structure, said composite panel including an inner metal skin and outer metal skin, with said inner metal skin of said composite panel having an inner surface for facing toward an interior of said railroad hopper car, and with the outer metal skin of said composite panel having an exposed outer surface, with said composite panel further including a plastic core member extending between said inner metal skin and outer metal skin;

edge structure secured in non-structural surrounding relation relative to said panel, and gasket structure for sealing said hatch cover to the upstanding coaming surrounding the hatch opening on the roof of said hopper car when said hatch cover is closed, wherein a portion of said gasket structure has an arcuate generally U-shape to match a profile of said upstanding coaming on the railroad hopper car.

31. The hatch cover according to claim 21 wherein the metal inner skin and metal outer skin of said composite panel combine to accommodate the attachment of hinge structure between the ends of said composite panel.

* * * * *